US012584409B2

(12) United States Patent
Perry

(10) Patent No.: US 12,584,409 B2
(45) Date of Patent: Mar. 24, 2026

(54) RACKBAR ROTATION LIMIT

(71) Applicant: Joy Global Underground Mining LLC, Warrendale, PA (US)

(72) Inventor: Ryan E. Perry, Venus, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 76 days.

(21) Appl. No.: 18/600,448

(22) Filed: Mar. 8, 2024

(65) Prior Publication Data

US 2024/0301793 A1 Sep. 12, 2024

Related U.S. Application Data

(60) Provisional application No. 63/489,623, filed on Mar. 10, 2023.

(51) Int. Cl.
*E21C 35/12* (2006.01)
*E21C 29/02* (2006.01)
*E21C 35/10* (2006.01)

(52) U.S. Cl.
CPC ..... *E21C 29/02* (2013.01); *E21C 35/10* (2013.01); *E21C 35/12* (2013.01)

(58) Field of Classification Search
CPC ..... E21C 29/02; E21C 35/12; F16H 19/04
See application file for complete search history.

(56) References Cited

U.S. PATENT DOCUMENTS

| | | | |
|---|---|---|---|
| 4,461,512 | A | 7/1984 | Tupikov et al. |
| 4,515,410 | A | 5/1985 | Trumper et al. |
| 4,813,747 | A | 3/1989 | Klimeck et al. |
| 4,850,648 | A | 7/1989 | Muller |
| 6,179,386 | B1 | 1/2001 | Meya et al. |
| 8,262,169 | B2 | 9/2012 | Hill |
| 8,276,991 | B2 | 10/2012 | Thomson |
| 8,393,687 | B2 | 3/2013 | Powell |
| 8,789,892 | B2 | 7/2014 | Niederriter et al. |
| 10,215,023 | B2 | 2/2019 | Perry et al. |
| 2012/0031210 | A1 | 2/2012 | Schmidt et al. |

FOREIGN PATENT DOCUMENTS

| | | | | |
|---|---|---|---|---|
| CN | 112647938 | A | 4/2021 | |
| DE | 3008959 | A1 * | 9/1981 | |
| WO | WO-2011010258 | A2 * | 1/2011 | ..... E21C 29/02 |

OTHER PUBLICATIONS

DE 3827399 (Year: 1990).*
DE 202009002021 (Year: 2009).*

* cited by examiner

*Primary Examiner* — Sunil Singh
(74) *Attorney, Agent, or Firm* — Husch Blackwell LLP

(57) ABSTRACT

A rackbar for a mining machine has a body including a first end and second end, an inner rack wall, an outer rack wall spaced from the inner rack wall, a plurality of gear teeth extending between the inner rack wall and the outer rack wall, an extension disposed adjacent the first end, a pin aperture positioned on the extension, and a rib extending along a surface of the extension. The inner and outer rack walls extend between the first end and the second end parallel to a rack axis. The extension extends in a direction perpendicular to the rack axis. The pin aperture is configured to receive a pin.

25 Claims, 15 Drawing Sheets

RACKBAR ROTATION LIMIT

CROSS-REFERENCE TO RELATED APPLICATION

This application claims the benefit of co-pending, prior-filed U.S. Provisional Patent Application No. 63/489,623, filed Mar. 10, 2023, the entire contents of which are incorporated by reference.

BACKGROUND

The present disclosure relates to the field of mining machines and particularly to a rack and clog for a face conveyor machine.

Conventional longwall shearers include a frame and a pair of cutting assemblies mounted on each end of the frame. Each cutting assembly includes a cutting drum for engaging a mine wall. As the frame traverses a mine face, the cutting drums cut material from the mine face. In some embodiments, the material is deposited on a conveyor and carried away from the mine face. The shearer includes a trapping shoe and sprocket that engage a rack to guide the machine with respect to the mine wall. The rack may be coupled to the conveyor (e.g., by a clog). The rack may loosely fit in the clog such that the rack is able to rotate in the clog. Rotation in certain directions can cause wear on the trapping shoe and sprocket teeth.

SUMMARY

In one independent aspect, a rackbar for a mining machine includes: a body including a first end and a second end; an inner rack wall extending between the first end and the second end along a rack axis; an outer rack wall spaced from the inner rack wall and extending between the first end and the second end parallel to the rack axis; a plurality of gear teeth, each of the gear teeth extending between the inner rack wall and the outer rack wall; an extension disposed adjacent the first end, the extension extending in a direction perpendicular to the rack axis; a pin aperture positioned on the extension and configured to receive a pin; and a rib extending along a surface of the extension.

In some aspects, the rib extends in a direction perpendicular to the rack axis.

In some aspects, the rib is one of a plurality of ribs, the ribs extending in the same direction.

In some aspects, the ribs extend in a direction perpendicular to the rack axis.

In some aspects, the ribs radially extend from the pin aperture.

In some aspects, the extension has an inner face and an outer face opposite the inner face, the rib disposed on the inner face.

In some aspects, the rib is an inner rib, and further comprising an outer rib disposed on the outer face.

In some aspects, the rackbar is a unitary body.

In another independent aspect, a clog for supporting a rackbar of a mining machine includes: a first wall extending in a first direction; a second wall spaced from the first wall, the second wall extending parallel to the first direction; a cavity between the first wall and the second wall, the cavity configured to receive a portion of the rackbar; a first pin aperture positioned on the first wall; a second pin aperture positioned on the second wall; and a rib positioned on one of the first wall and the second wall, the rib positioned on a surface adjacent the cavity.

In some aspects, the rib extends in a second direction that is perpendicular to the first direction.

In some aspects, the rib is one of a plurality of ribs, the ribs extending in the same direction.

In some aspects, the ribs extend in a second direction that is perpendicular to the first direction.

In some aspects, the rib is a first rib and is positioned on the first wall, further comprising a second rib positioned on a surface of the second wall adjacent the cavity.

In some aspects, the first rib and the second rib extend in a second direction perpendicular to the first direction.

In some aspects, the first rib extends from the first pin aperture.

In some aspects, the rib includes a curved abutment surface.

In yet another independent aspect, a mining machine includes a rackbar and a clog supporting the rackbar. The rackbar includes: a body including a first end and a second end, an inner rack wall extending between the first end and the second end along a rack axis, an outer rack wall spaced from the inner rack wall and extending between the first end to the second end parallel to the rack axis, a plurality of gear teeth, each of the gear teeth extending between the inner rack wall and the outer rack wall, an extension disposed adjacent the first end, the extension extending in a direction perpendicular to the rack axis, a pin aperture positioned on the extension, and an inner rack rib extending along a surface of the extension. The clog includes: a first wall extending parallel to the rack axis, a second wall spaced from the first wall, the second wall extending parallel the rack axis, a cavity between the first wall and the second wall, the cavity configured to receive the extension of the rackbar, a first pin aperture disposed on the first wall, a second pin aperture disposed on the second wall, a clog rib positioned on one of the first wall and the second wall, the clog rib positioned on a surface adjacent the cavity, and a pin securing the rackbar to the clog.

In some aspects, the inner rack rib and the first clog rib extend along a first direction.

In some aspects, the first direction is perpendicular to the rack axis.

In some aspects, the inner rack rib is one of a plurality of inner rack ribs, and the first clog rib is one of a first plurality of clog ribs.

In some aspects, the extension has an inner face and an outer face opposite the inner face, wherein the inner rack rib is disposed on the inner face, and the outer face includes an outer rack rib.

In some aspects, the second wall includes a second clog rib extending along the second wall adjacent the cavity.

In some aspects, the inner rack rib, the outer rack rib, the first clog rib, and the second clog rib extend perpendicular to the rack axis.

In some aspects, the inner rack rib is engaged with the first clog rib and the outer rack rib is engaged with the second clog rib when the rackbar is supported by the clog.

In some aspects, the inner rack rib includes a flat abutment surface, and the first clog rib includes a curved abutment surface.

In some aspects, the inner rack rib engages the first clog rib when the rackbar is supported by the clog.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings, and can include electrical or fluid connections or couplings, whether direct or indirect. Also, electronic communications and notifications may be performed using any known means including direct connections, wireless connections, etc.

Figure 1:
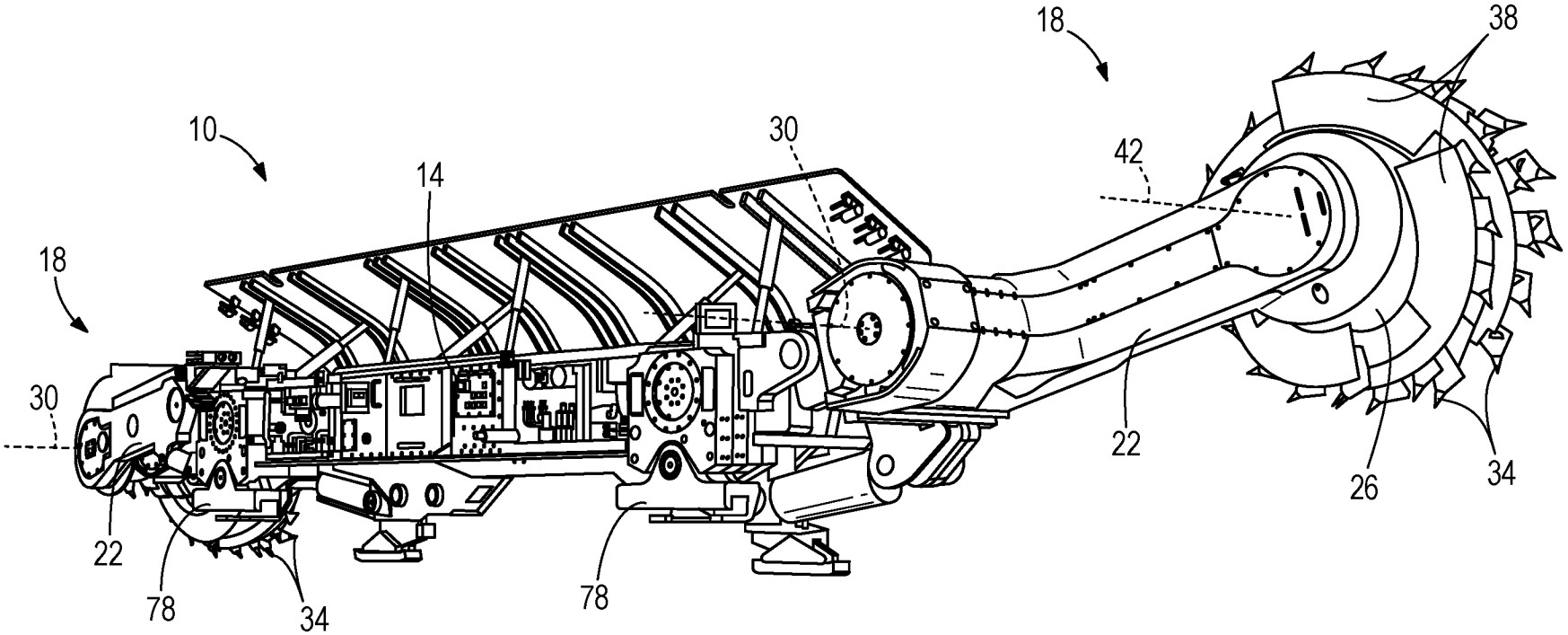
FIG. 1 is a perspective view of a mining machine.

FIG. 1 illustrates a mining machine, such as a longwall shearer 10. In the illustrated embodiment, the shearer 10 includes a chassis or frame 14 and a pair of cutting assemblies 18. Each cutting assembly 18 includes a ranging arm 22 and a cutting drum 26. Each ranging arm 22*a*, 22*b* (FIG. 2) is pivotably coupled to a respective end of the frame 14 and pivots about an arm axis 30. Each ranging arm 22*a*, 22*b* also rotatably supports the cutting drum 26. Each cutting drum 26*a*, 26*b* (FIG. 2) includes a generally cylindrical body and cutting bits 34. In the illustrated embodiment, vanes 38 (FIG. 1) extend in a helical manner along an outer surface or periphery of the cutting drum 26, and the cutting bits 34 are positioned along the edges of the vanes 38 (for simplicity, each cutting drum 26 is illustrated as a cylinder in FIG. 2). The cutting drum 26 is coupled to the ranging arm 22 and is rotatable about a drum axis 42 that is substantially parallel to the arm axis 30.

Figure 2:
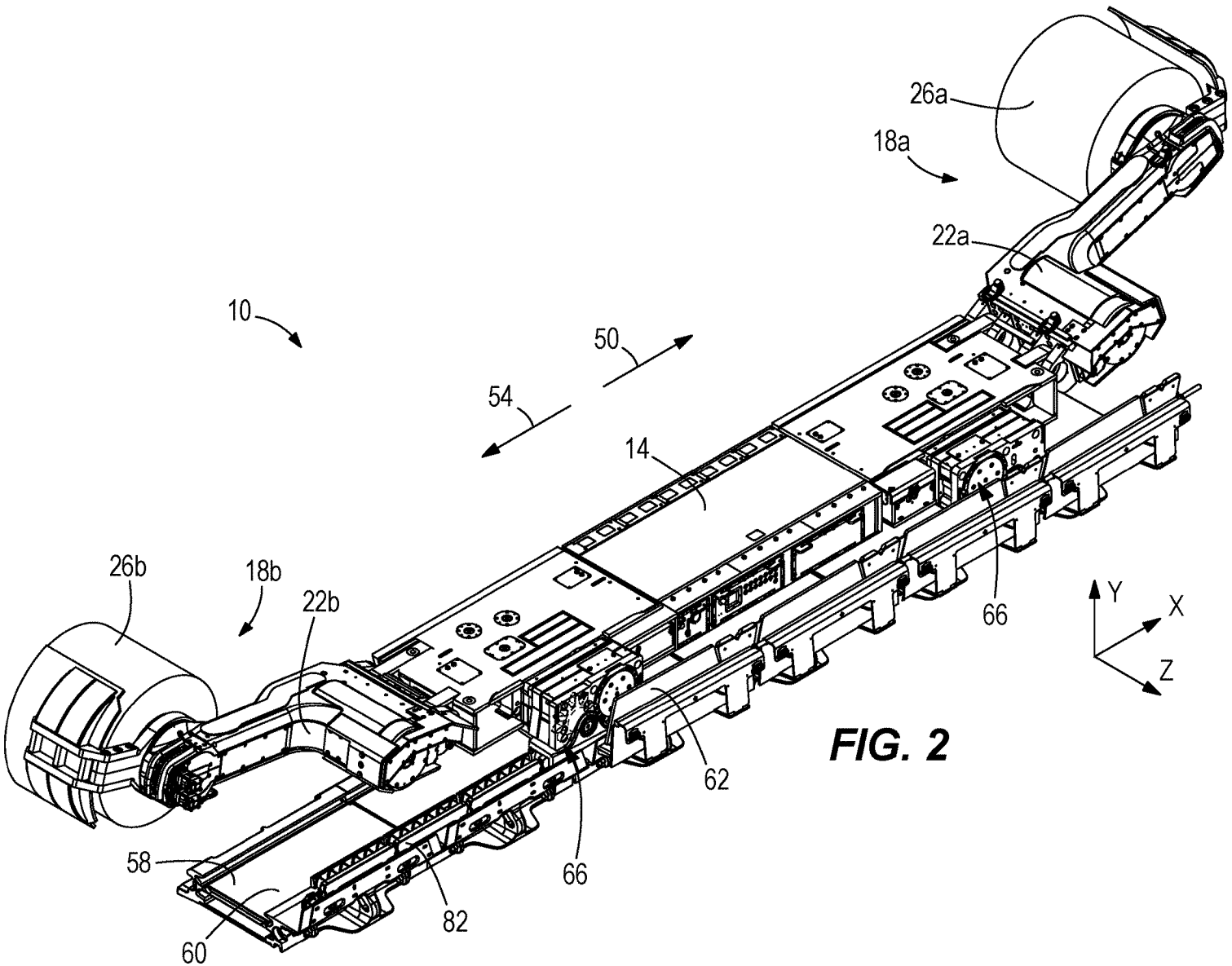
FIG. 2 is another perspective view of the mining machine of FIG. 1.
Figure 3:
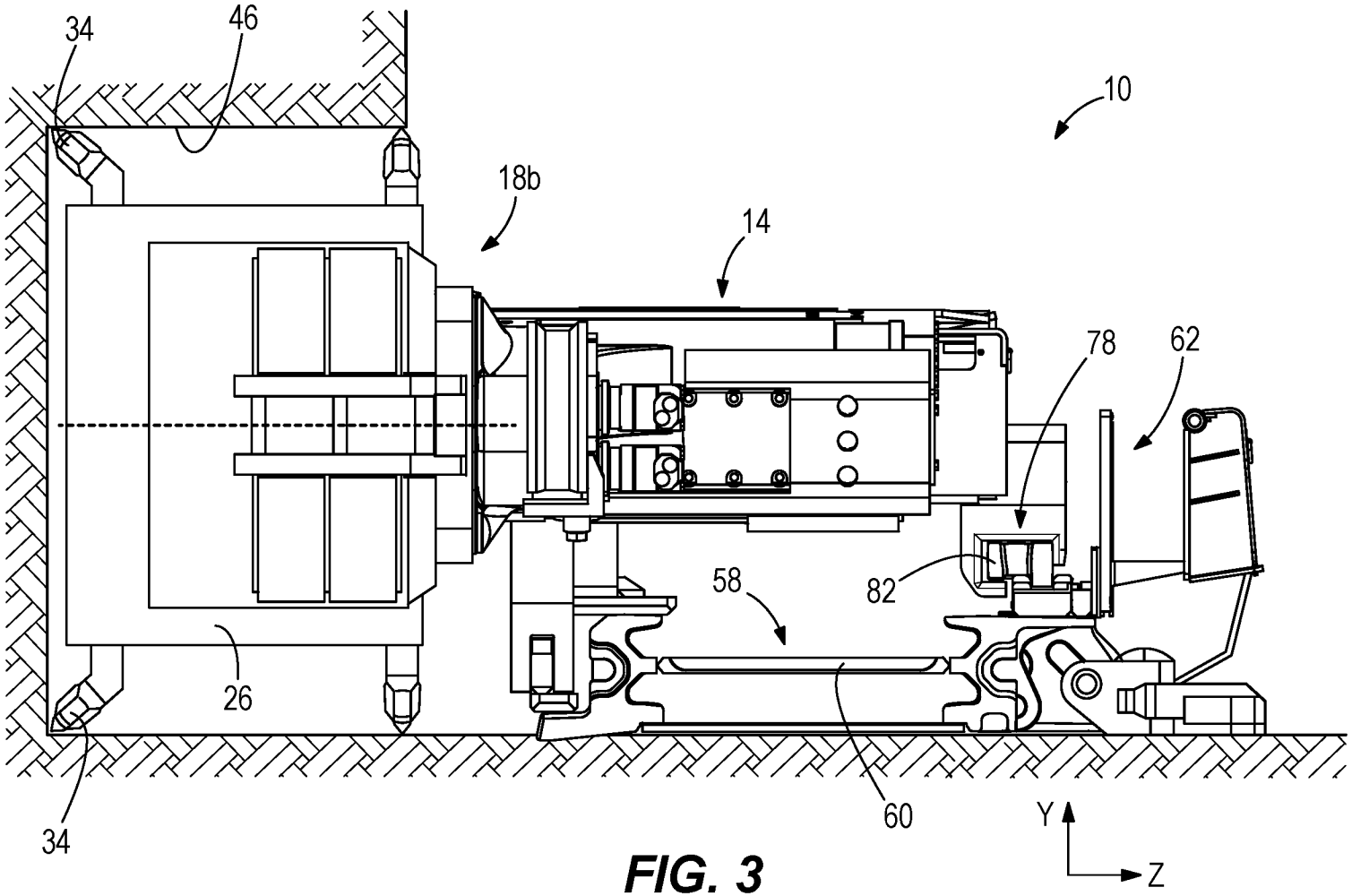
FIG. 3 is an end view of the mining machine of FIG. 1 engaging a mine wall.

As shown in FIGS. 2 and 3, the frame 14 is configured to tram or move along a mine face or mine wall 46 of material (FIG. 3) to be mined in a first direction 50 (FIG. 2) and a second direction 54 (FIG. 2). Each cutting drum 26 engages the mine wall 46 such that the cutting bits 34 (FIG. 1) cut material from the mine wall 46. As the cutting drum 26 rotates, the vanes 38 (FIG. 1) carry the cut material from the mine wall 46 toward a rear end of the cutting drum 26, where the cut material is deposited onto a face conveyor 58. The face conveyor 58 includes a plurality of pans 60 that collect the cut material. The face conveyor 58 carries the material toward a gate conveyor to be transported out of the mine. In the illustrated embodiment, spill plates 62 are positioned behind the frame 14 (i.e., away from the mine wall 46) to prevent cut material from falling behind the face conveyor 58 and ensure all the cut material is collected by the pans 60. In FIG. 2, one of the spill plates 62 is removed to clearly show the face conveyor 58. In addition, a roof support (not shown) may be positioned behind the face conveyor 58 and the spill plates 62.

As shown in FIG. 2, as the frame 14 moves in the first direction 50, a first cutting assembly 18*a* is in a leading position and a second cutting assembly 18*b* is in a trailing position. In one embodiment, the leading position is an elevated position in order to cut material, such as coal, from an upper portion of the mine wall 46, while the trailing position is a lower position to cut material from a lower portion of the mine wall 46.

Figure 4:
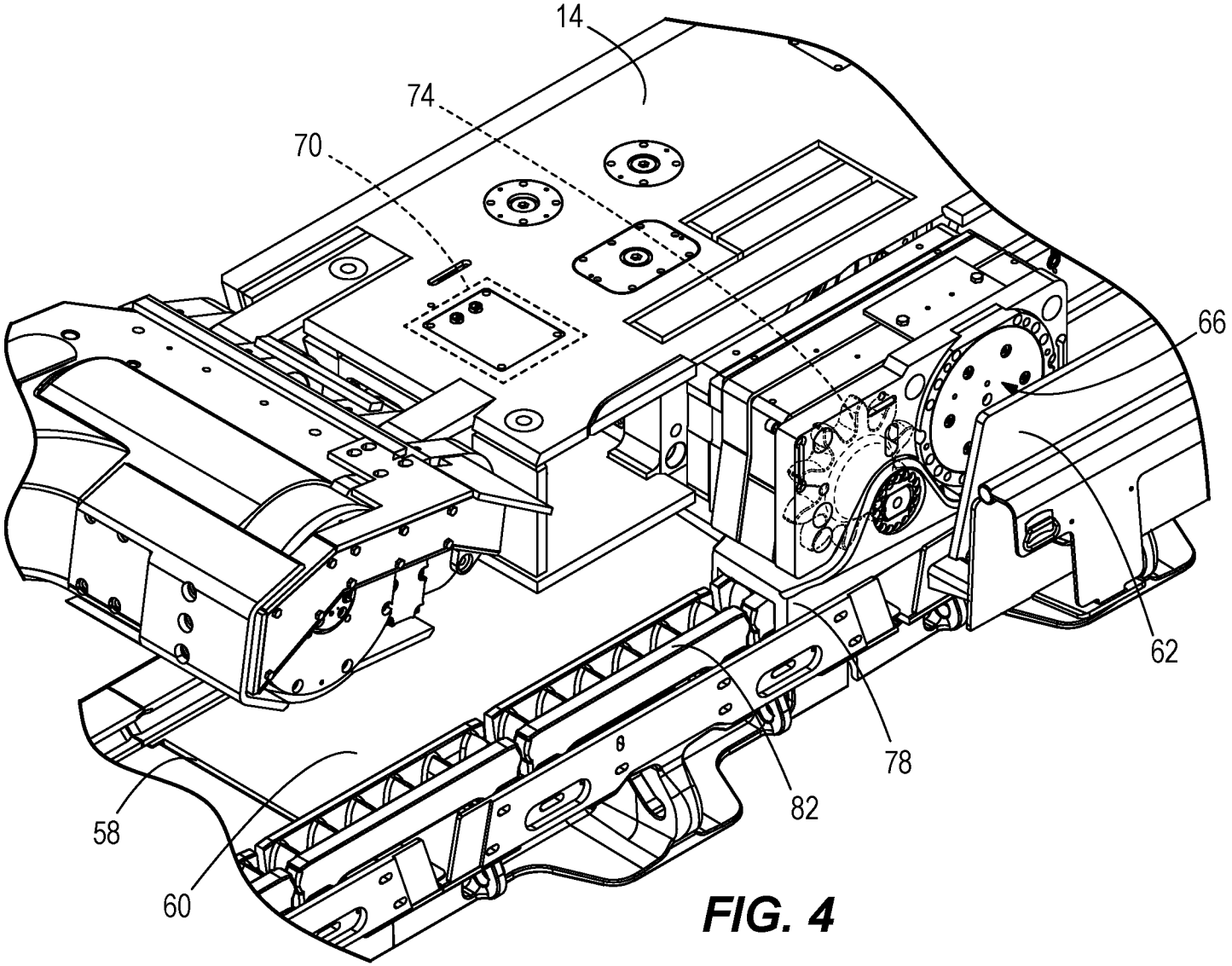
FIG. 4 is an enlarged perspective view of a portion of the mining machine of FIG. 1.

Referring now to FIG. 4, the frame 14 includes a drive mechanism 66 for moving the frame 14. The drive mechanism 66 includes a motor 70 driving an output shaft, which in turn drives a gear or sprocket 74. The sprocket 74 engages a rackbar or a rack 82 to form a rack-and-pinion connection, such that rotation of the sprocket 74 causes translational movement of the frame 14 along the rack 82.

The sprocket 74 is supported by a trapping shoe or guide shoe 78 that is coupled to the frame by a shaft (e.g., a pin). The guide shoe 78 guides the movement of the frame 14 relative to the rack 82 along the mine face and maintains alignment and engagement between the sprocket 74 and the rack 82. In the illustrated embodiment, a guide shoe 78 is positioned proximate each end of the frame 14; in other embodiments, the mining machine 10 may include fewer or more guide shoes.

Figure 5:
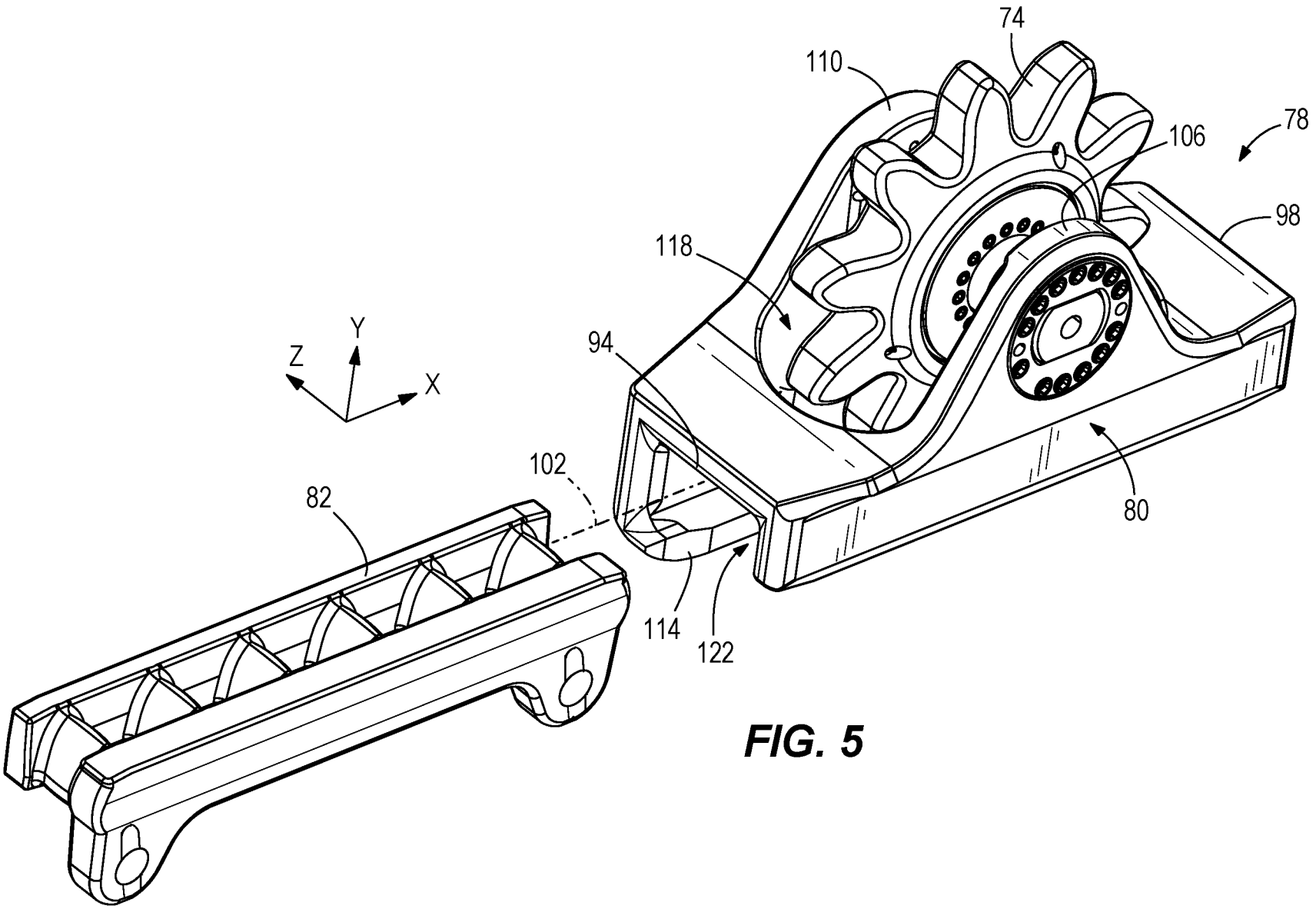
FIG. 5 is a perspective view of a guide shoe.

Referring to FIG. 5, the guide shoe 78 includes a shoe body 80. The shoe body 80 includes a first end 94 and a second end 98. A first wall or first lug 106 is positioned adjacent a first side of the shoe body 80 and a second wall or second lug 110 positioned adjacent a second side of the shoe body 80. The first lug 106 and the second lug 110 extend from the first end 94 to the second end 98. An opening 118 is defined between the first lug 106 and the second lug 110. The sprocket 74 is received in the opening 118.

The shoe body 80 includes a slot 122 that extends longitudinally between the first end 94 and the second end 98 along a slot axis 102. The second lug 110 may include a gob or hook 114 that extends around a portion (e.g., a lower side) of the rack 82 to maintain engagement between the guide shoe 78 and the rack 82. In the illustrated embodiment, a cross-section of the slot 122 transverse to the slot axis 102 forms an incomplete rectangle.

Figure 6:
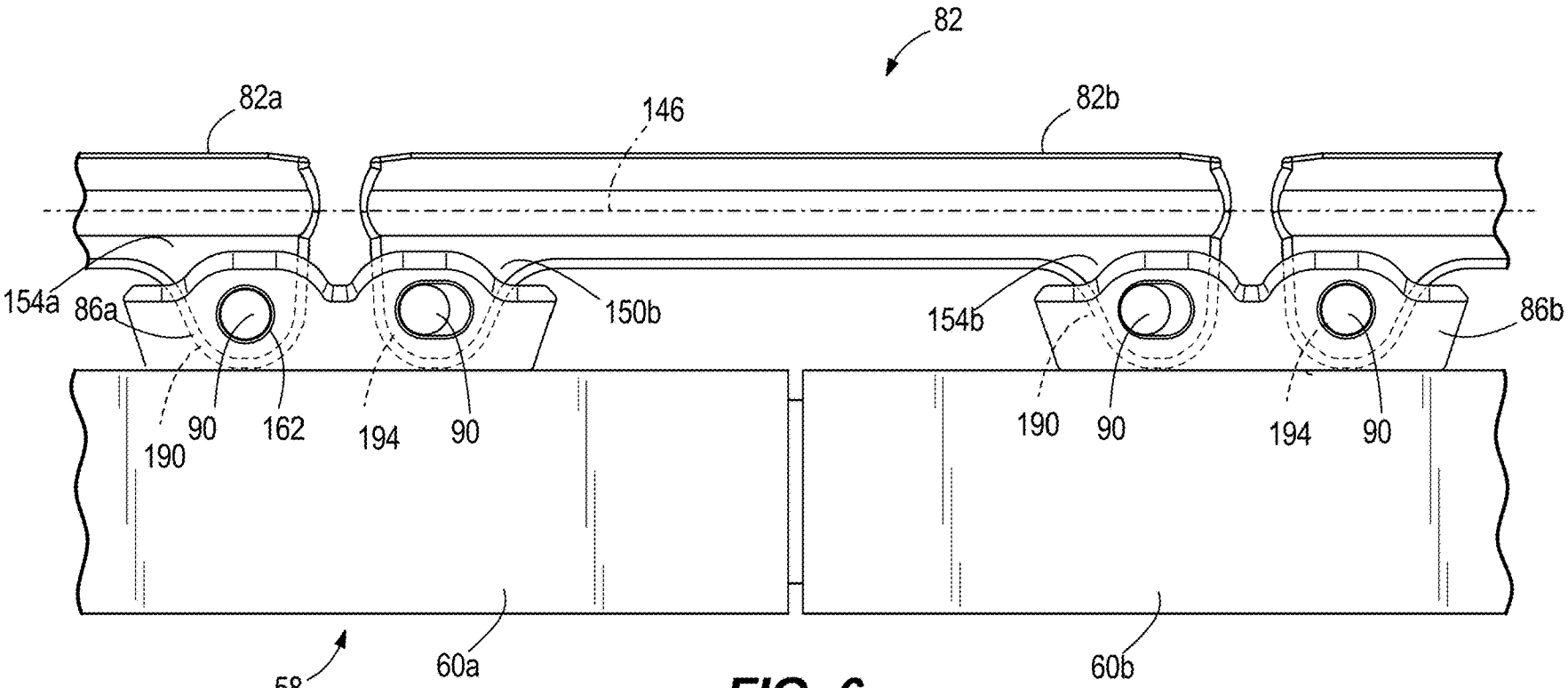
FIG. 6 is a schematic of the conveyor and rack of FIG. 2.
Figure 7:
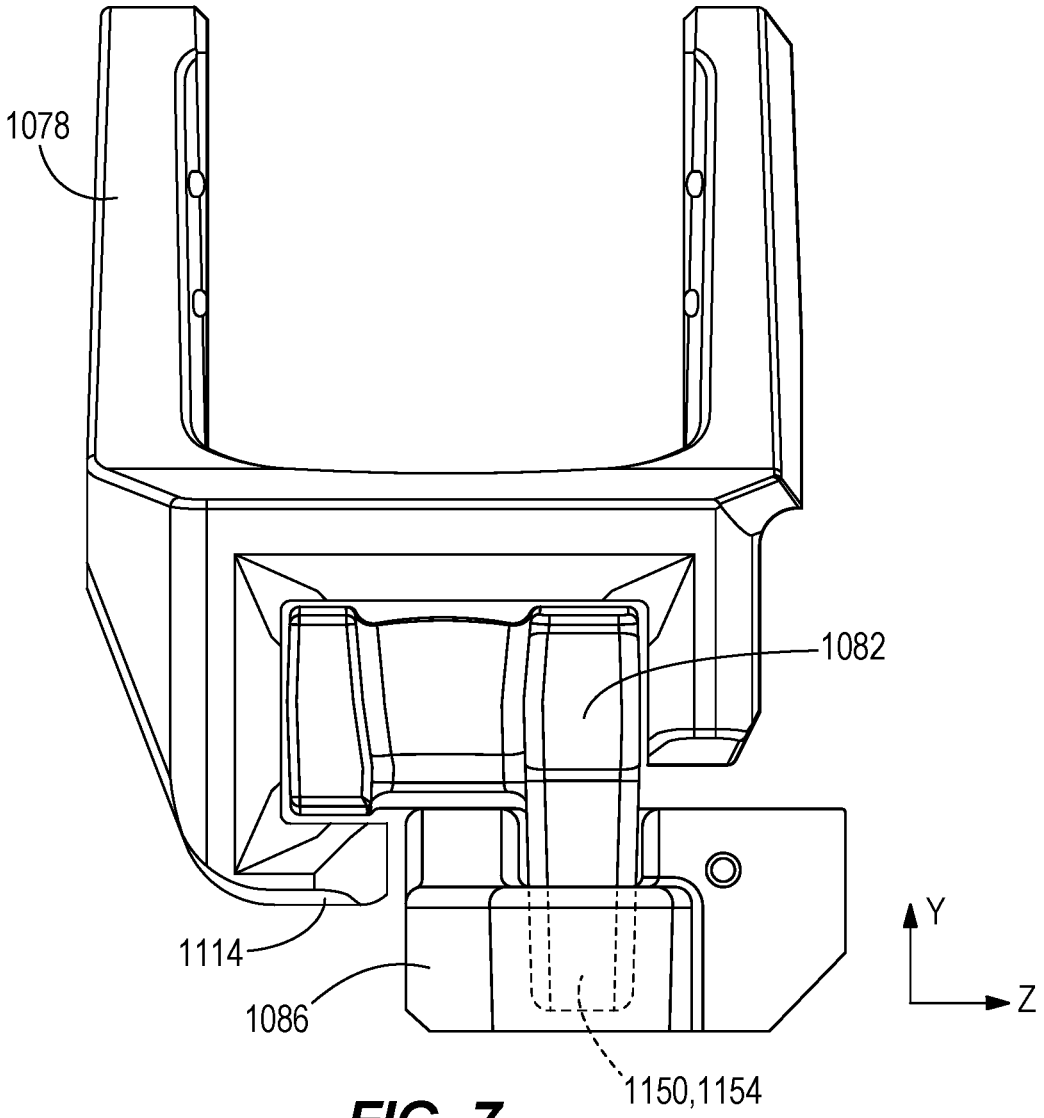
FIG. 7 PRIOR ART
FIG. 7 is an end view of a prior art rack, guide shoe, and clog.

With reference to FIGS. 6, the rack 82 is coupled to the face conveyor 58 via a clog 86 and extends along the mine wall 46. A pin 90 secures the rack 82 to the clog 86. The clog 86 is mounted onto one of the pans 60. The clog 86 provides a loose fit to the rack 82 such that the rack 82 can rotate relative to the clog 86. In the prior art (FIGS. 7-11), the rack 82 can freely rotate about a first axis that extends along the Y-direction (e.g., in a direction normal to a plane defined by an upper surface of the rack 82; a vertical direction as shown in FIGS. 7-11), a second axis that extends along the Z-direction (e.g., along the pin 90), and a third axis that extends along the X-direction (e.g., along the direction of travel 50, 54). Rotation of the rack 82 about the first axis is achieved as the pan 60 moves along the direction of travel 50, 54. Rotation of the rack 82 about the second axis is achieved with rotation about the pin 90. Excess rotation of the rack 82 about the third axis is undesirable, as described in detail below.

FIGS. 7-11, illustrate a trapping shoe 1078, a rack 1082, and a clog 1086 of the prior art. The trapping shoe 1078 has a first lug 1106, a second lug 1110, and a hook 1114 that extends from the second lug 110. The trapping shoe includes a first wall surface 1108 that extends below the first lug 1106, a second wall surface 1112 that is between the second lug 1110 and the hook 1114, and a top surface 1124 that extends between the first wall surface 1108 and the second wall surface 1112. The first wall surface 1108, the second wall surface 1112, and the top surface 1124 form a slot or cavity 1122 that is configured to receive the rack 1082.

The rack 1082 includes an inner rack wall 1138 and an outer rack wall 1142. The inner rack wall 1138 and the outer rack wall 1142 extend along a rack axis (not shown). The rack axis extends in the X-direction. The outer rack wall 1142 includes a first rack extension 1150 and a second rack extension 1154. The first and second rack extensions 1150, 1154 are received in the clog 1086.

Figure 8:
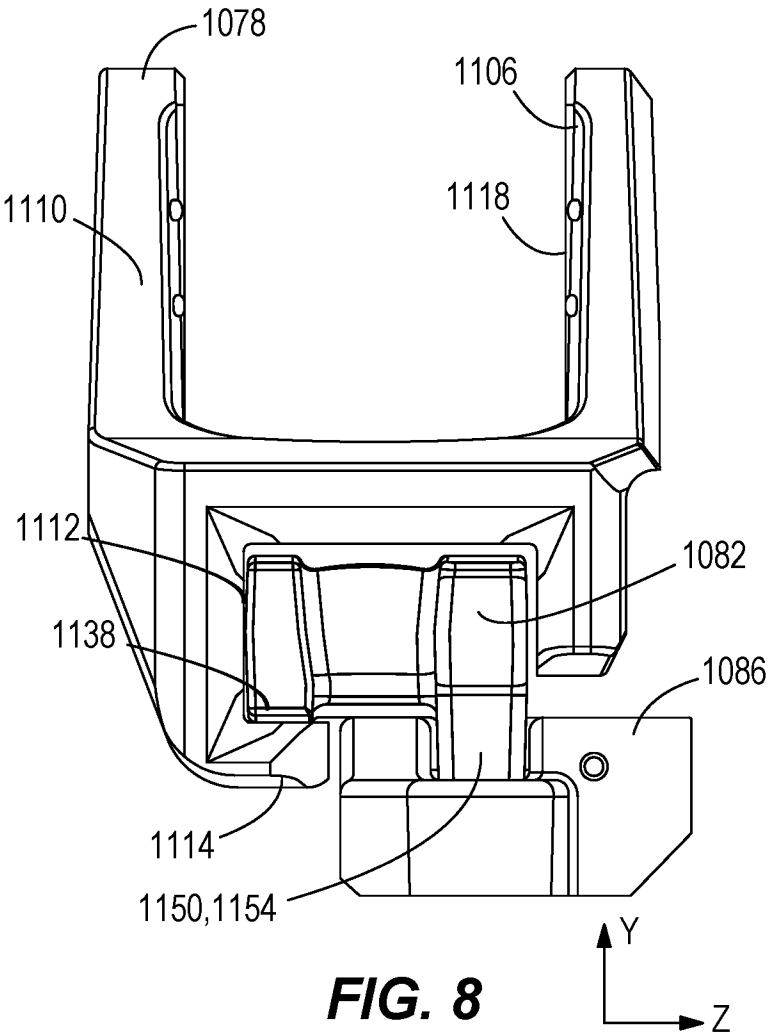
FIG. 8 PRIOR ART
FIG. 8 is an end view of a prior art rack, guide shoe, and clog, with the shoe lifted.

In FIG. 8, the trapping shoe 1078 is in a lifted and outwardly-shifted position such that the rack 1082 is positioned against the second wall surface 1112 of the trapping shoe 1078 and is positioned against the hook 1114. More specifically, the inner rack wall 1138 contacts the second wall surface 1112 and the hook 1114.

Figure 9:
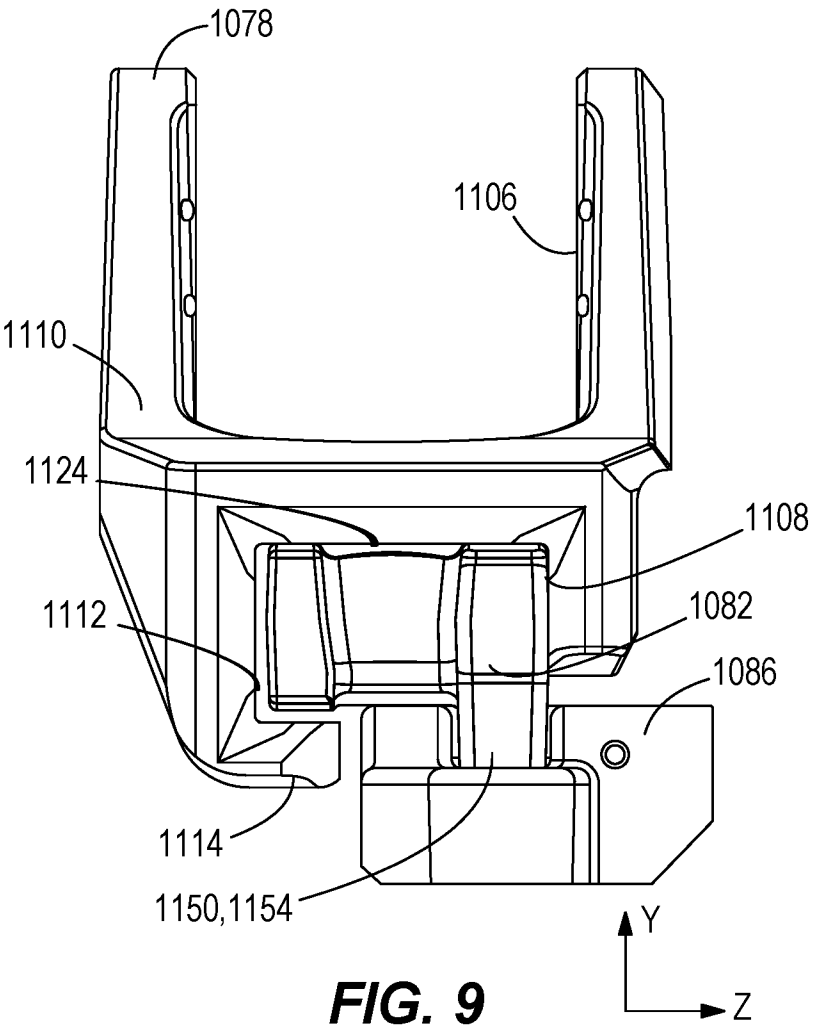
FIG. 9 PRIOR ART
FIG. 9 is an end view of a prior art rack, guide shoe, and clog, with the shoe pushed down.

In FIG. 9, the trapping shoe 1078 is in a lowered and inwardly-shifted position such that the rack 1082 is positioned against the first wall surface 1108 and is positioned against the top surface 1124. More specifically, the outer rack wall 1142 contacts the first wall surface 1108 and the top surface 1124.

Figure 11:
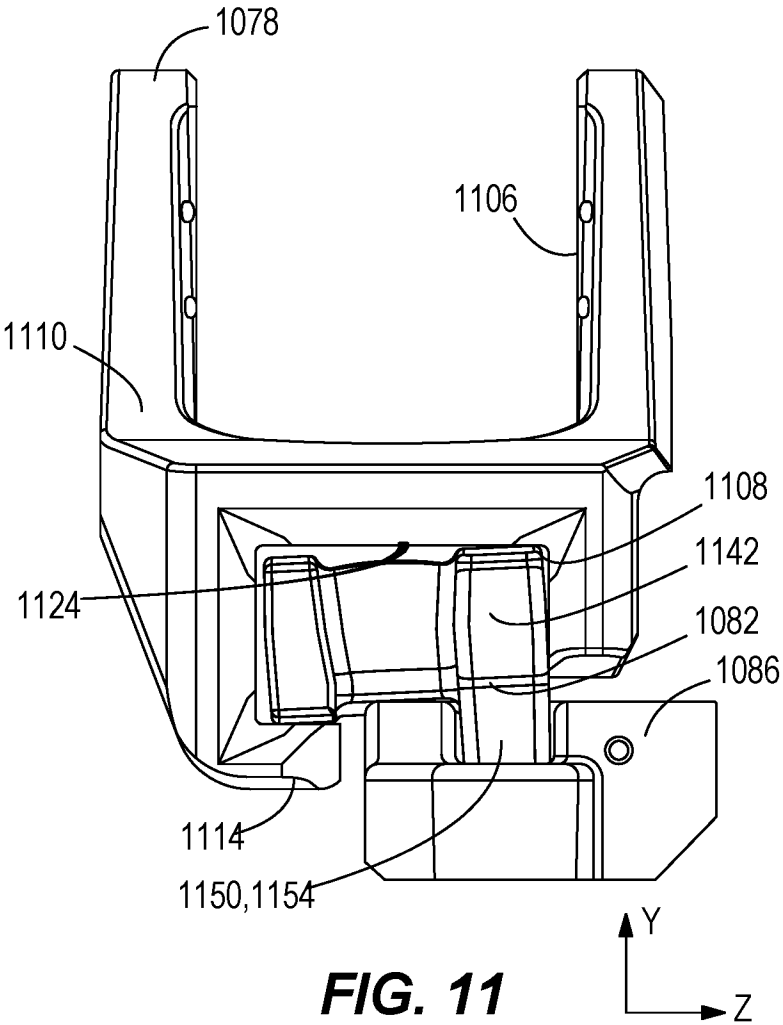
FIG. 11 PRIOR ART
FIG. 11 is an end view of a prior art rack, guide shoe, and clog, with the rack angled down.
Figure 10:
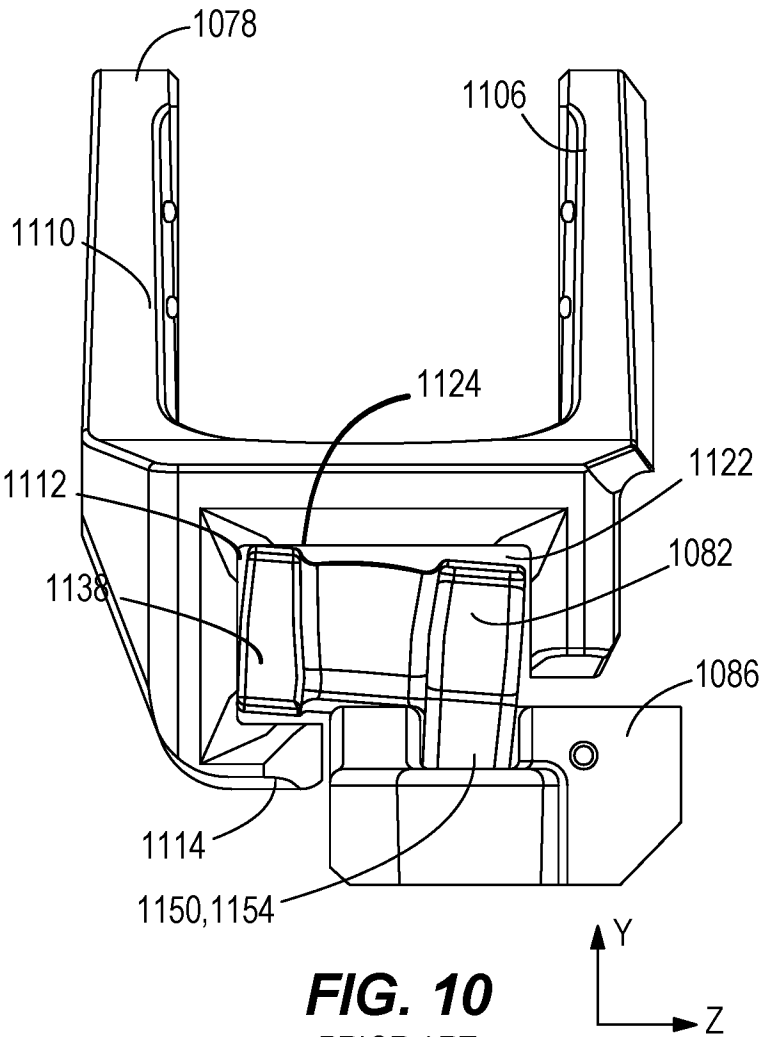
FIG. 10 PRIOR ART
FIG. 10 is an end view of a prior art rack, guide shoe, and clog, with the rack angled up.

In FIGS. 10 and 11, the rack 1082 is rotated relative to the trapping shoe 1078 and the clog 1086. More specifically, the rack 1082 is rotated about the rack axis. In FIG. 10, the rack 1082 is angled up such that the inner rack wall 1138 contacts the second wall surface 1112 and the top surface 1124. In FIG. 11, the rack 1082 is angled down such that a portion of the inner rack wall 1138 contacts the hook 1114 while the outer rack wall 1142 contacts the top surface 1124 and the first wall surface 1108.

In FIGS. 10 and 11, the rotation of the rack 1082 about the rack axis causes the rack 1082 to be angled relative to the trapping shoe 1078 which causes undesirable lateral movement of the shearer. If the rack 1082 is allowed to rotate about the rack axis, there is more lateral movement when the trapping shoe 1078 is in the lifted position than there is when the trapping shoe 1078 is in the lowered position. The undesirable lateral movement of the shearer can affect the clearances at the spill plates, can put more lateral movement on the ranging arms and cutting drums, and can cause the ranging arms to wedge in front of the pans or the cutting drums to contact the roof support.

The inventive embodiment of the rack 82 and clog 86 (shown in FIGS. 5-6 and 12-21) may include one or more protrusions or ribs (described below in detail) that create a closer tolerance between the rack 82 and the clog 86 in one direction to limit the rotation of the rack 82 about the third axis (i.e., the X-axis) in order to prevent excess rotation of the rack 82 about the third axis, but allow the rotation about the first and second axes (i.e., the Y-axis and the Z-axis).

Figure 12:
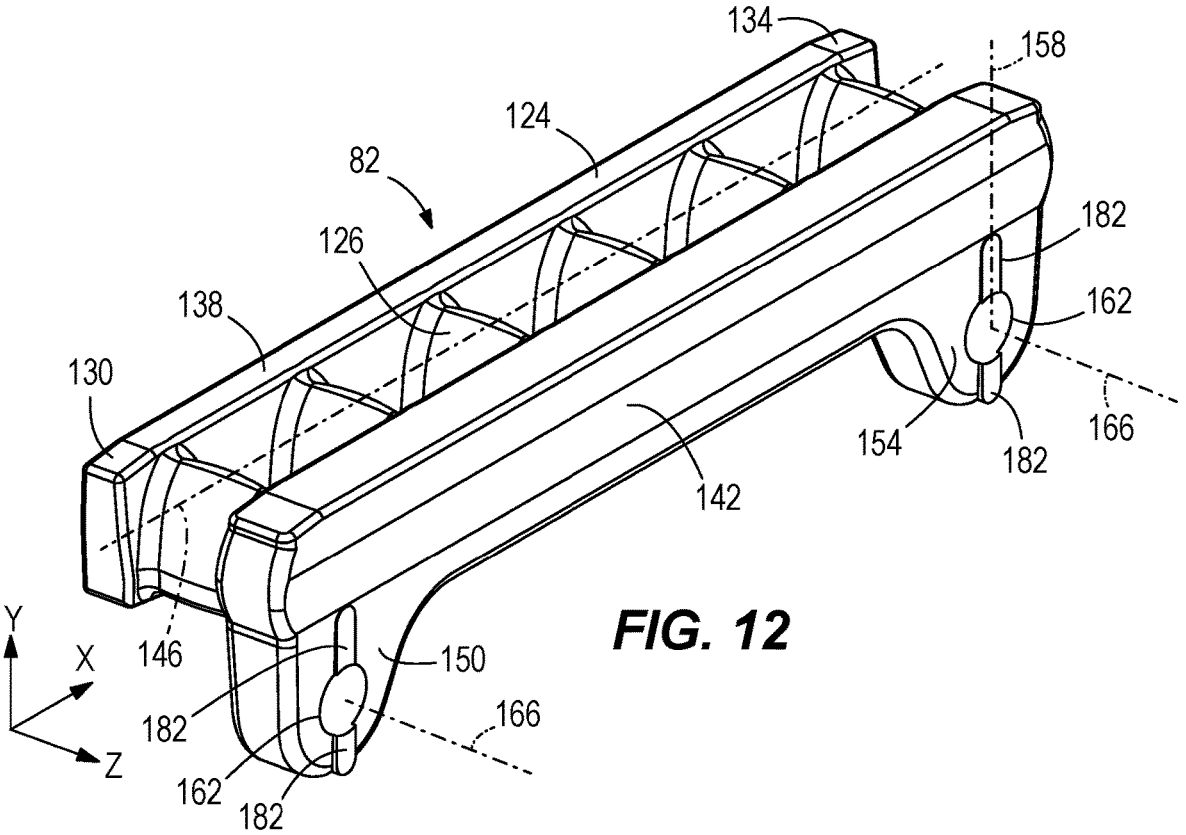
FIG. 12 is a perspective view of a rack.

With reference to FIGS. 6 and 12, the rack 82 includes a rack body 124 defining a first end 130 and a second end 134. The rack body 124 includes a first rack wall or an inner rack wall 138 and a second rack wall or an outer rack wall 142 spaced from the inner rack wall 138. The inner rack wall 138 is closer to the mine wall 46 than the outer rack wall 142 is. The inner rack wall 138 and the outer rack wall 142 extend from the first end 130 to the second end 134 along a first axis or longitudinal rack axis 146. A set of gear teeth 126 are disposed between the inner rack wall 138 and the outer rack wall 142 and extend along the rack axis 146. The rack axis 146 is in the direction of travel 50, 54 and extends in the X-direction.

The outer rack wall 142 includes a first rack extension 150 adjacent the first end 130 and a second rack extension 154 adjacent the second end 134. The rack extensions 150, 154 may be disposed on the ends 130, 134, or in other embodiments, the rack extensions 150, 154 may be spaced from the ends 130, 134. The rack extensions 150, 154 extend along a second axis or vertical rack axis 158. The vertical rack axis 158 extends in the Y-direction and is perpendicular to the rack axis 146. In the illustrated embodiment, the first and second rack extensions 150, 154 have a generally semi-circular shape, however in other embodiments, the first and second rack extensions may have different shapes (e.g., tear drop, oval, etc.).

Figure 13:
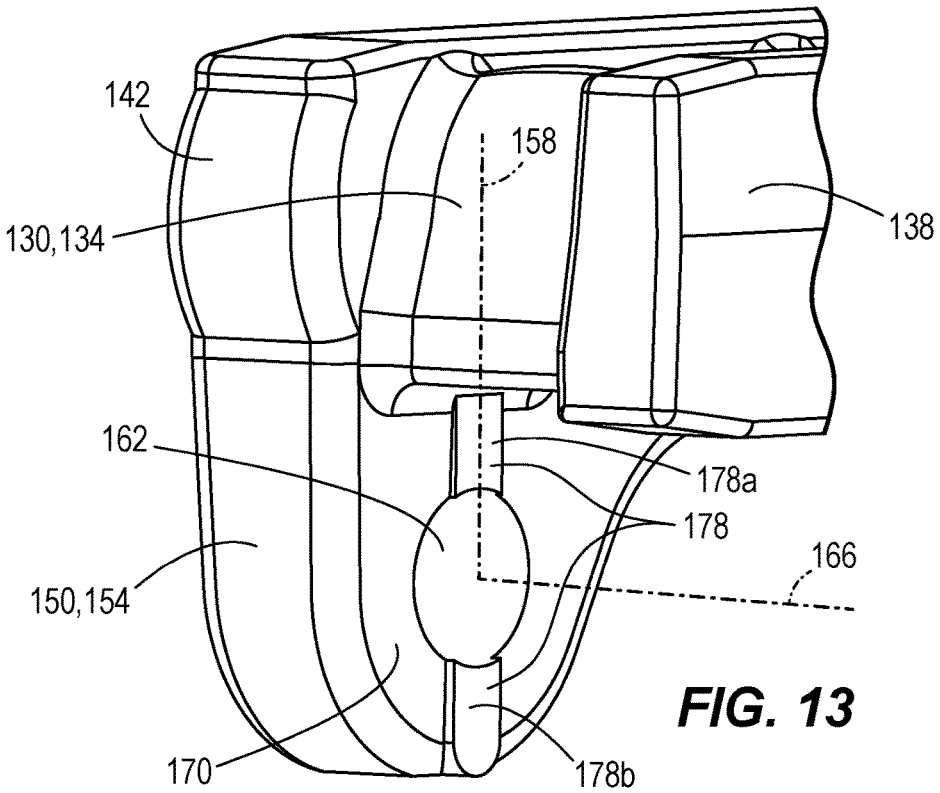
FIG. 13 is a detailed perspective view of a portion of the rack of FIG. 12.
Figure 14:
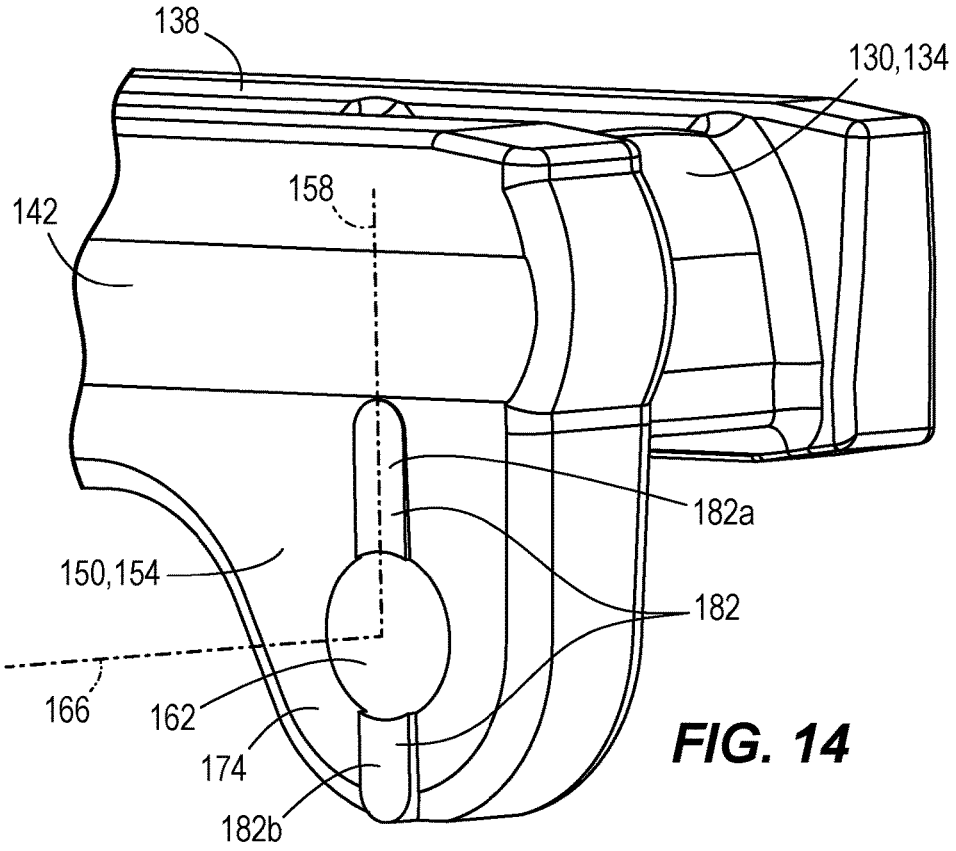
FIG. 14 is another detailed perspective view of a portion of the rack of FIG. 12.

With reference to FIGS. 13 and 14, each rack extension 150, 154 includes a pin aperture 162 configured to receive the pin 90. The rack extensions 150, 154 have an inner extension face 170 (e.g., the inner face) and an outer extension face 174 (e.g., the outer face) opposite the inner extension face 170. The pin aperture 162 extends from the inner extension face 170 to the outer extension face 174. The pin aperture 162 defines a pin axis of rotation 166. In the illustrated embodiment, the pin axis of rotation 166 is oriented in the Z-direction and is perpendicular to the vertical rack axis 158 and the longitudinal rack axis 146.

As shown in FIG. 13, the inner extension face 170 may include at least one inner protrusion or inner rib 178 that extends at least partially along the surface of the inner extension face 170. The inner rib 178 creates a raised surface on the inner extension face 170. In the illustrated embodiment, the inner rib 178 extends radially from the pin aperture 162. In the illustrated embodiment, the pin aperture splits the inner rib 178 such that the inner rib 178 includes a first inner rib **178*a* on one side of the pin aperture 162 and a second inner rib 178*b* on a different side of the pin aperture 162. The first and second inner ribs (e.g., the inner set of ribs) 178*a*, 178*b* are aligned in one direction. More specifically, the inner set of ribs 178***a*, 178*b* extend in the Y-direction parallel to the vertical rack axis 158 and extend perpendicular to the rack axis 146. In another embodiment, the inner rib 178 may extend in the Y-direction and be adjacent the pin aperture 162. In yet another embodiment, the inner set of ribs 178*a*, 178*b* may extend in the Y-direction and be positioned on either side of the pin aperture 162 instead of extending radially from the pin aperture 162.

As shown in FIG. 14, the outer extension face 174 may include at least one outer protrusion or outer rib 182 that extends at least partially along the surface of the outer extension face 174. The outer rib 182 creates a raised surface on the outer extension face 174. In the illustrated embodiment, the outer rib 182 extends radially from the from pin aperture 162. In the illustrated embodiment, the pin aperture 162 splits the outer rib 182 such that the outer rib 182 includes a first outer rib 182*a* on one side of the pin aperture 162 and a second outer rib 182*b* on a different side of the pin aperture 162. The outer set of ribs 182*a*, 182*b* are similar to the inner set of ribs 178*a*, 178*b*. The first and second outer ribs 182*a*, 182*b* extend in the same direction as the inner set of ribs 172*a*, 172*b*, and more specifically they extend in the Y-direction parallel to the vertical rack axis 158. In another embodiment, the outer rib 182 may extend in the Y-direction and be adjacent the pin aperture 162. In yet another embodiment, the outer set of ribs 182*a*, 182*b* may extend in the Y-direction and be positioned on either side of the pin aperture 162 instead of extending radially from the pin aperture 162.

The inner and outer rib 178, 182 may be integrally formed with the rack 82 such that the rack 82 is one unitary body, or the inner and outer rib 178, 182 may be separate pieces that are installed or fastened onto the extension faces 170, 174. The inner and outer rib 178, 182 may be formed from the same material as the rack 82 or the inner and outer rib 178, 182 may be formed from a different material (e.g., elastic or rubber). The inner and outer rib 178, 182 may also have a rough finish (e.g., a speckled surface) to increase the friction coefficient of the inner and outer rib 178, 182. In the illustrated embodiment, the inner and outer rib 178, 182 have a generally rectangular shape, but in other embodiments the inner and outer rib 178, 182 may have another elongated shape (e.g., oval shape, diamond shape, elongated hexagon). The inner and outer rib 178, 182 may define a flat abutment surface, or in other embodiments, the inner and outer rib 178, 182 may define a curved abutment surface.

Figure 15:
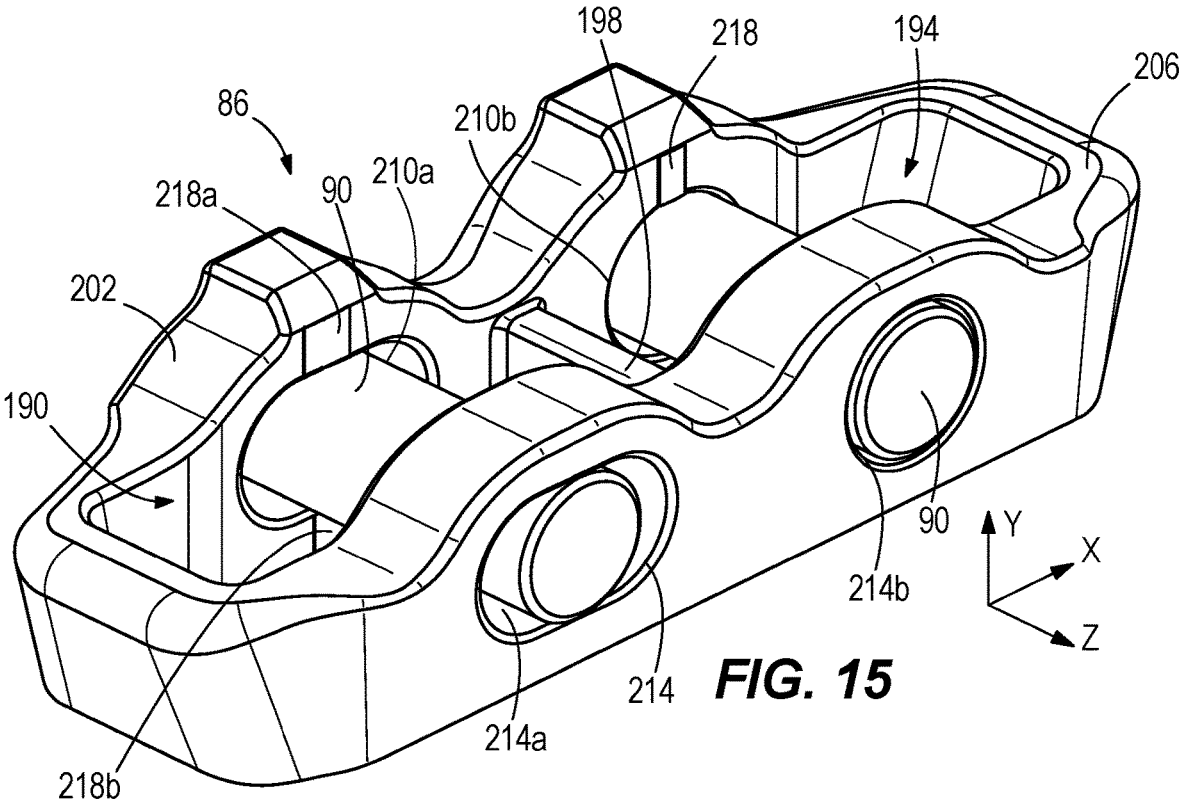
FIG. 15 is a perspective view of a clog.
Figure 16:
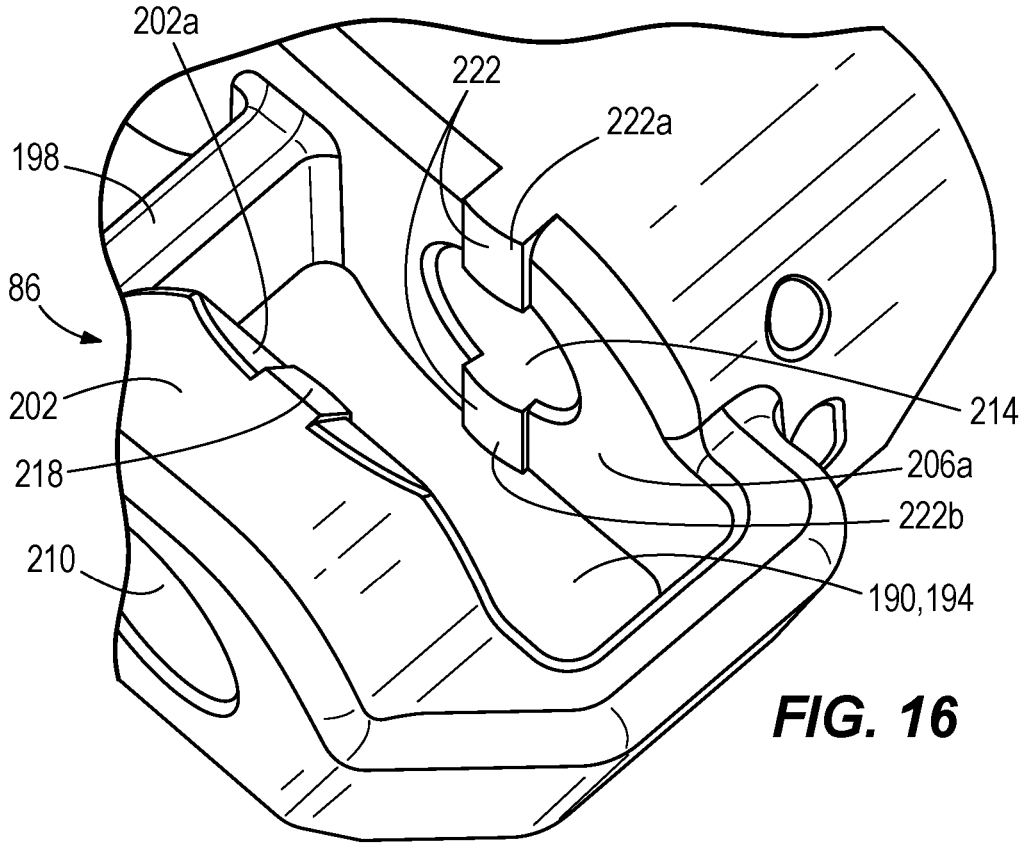
FIG. 16 is a detailed perspective view of a portion of the clog of FIG. 15.
Figure 17:
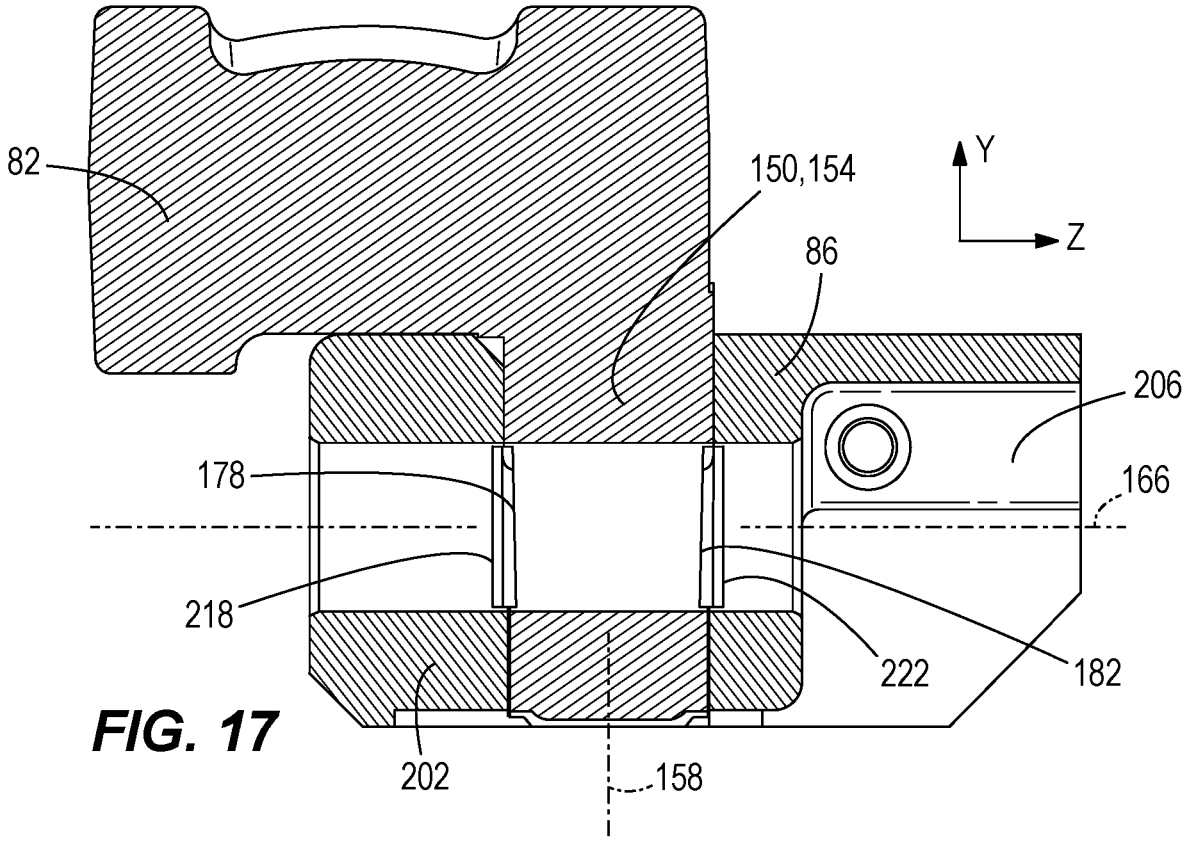
FIG. 17 is a section view of the rack of FIG. 12 and the clog of FIG. 15.
Figure 18:
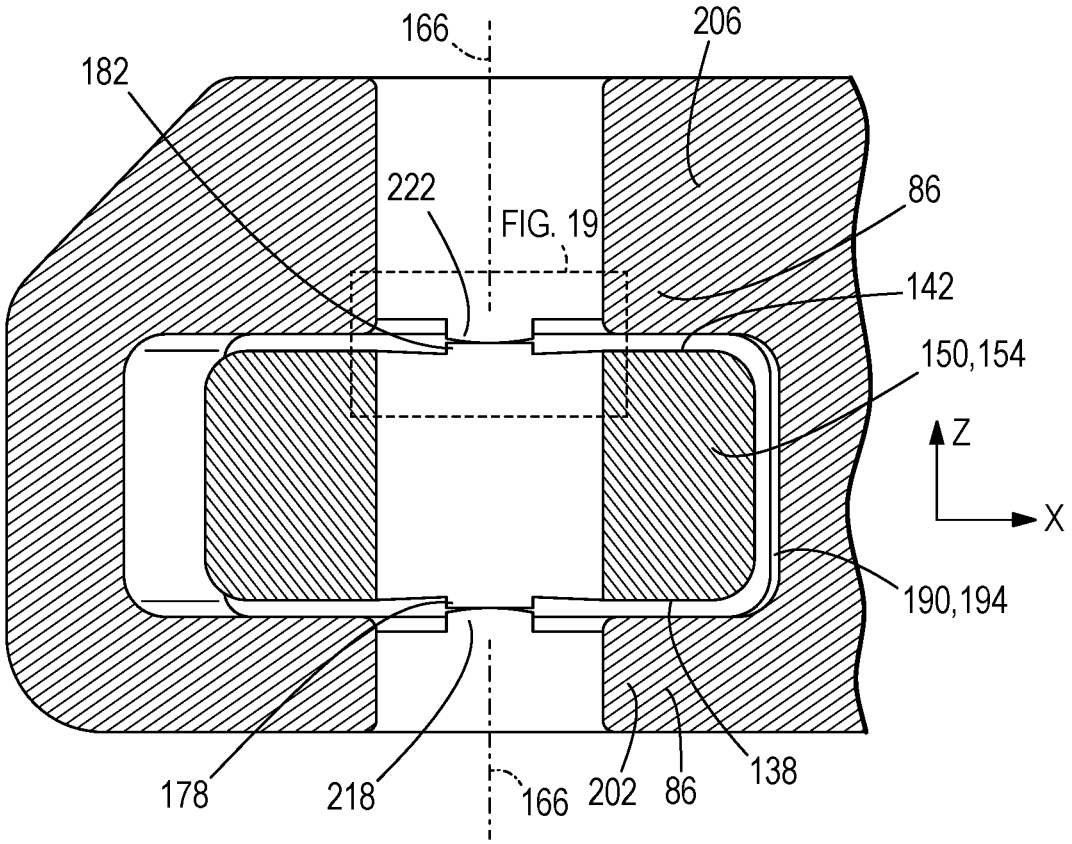
FIG. 18 is a section view of the rack of FIG. 12 and the clog of FIG. 15.

With reference to FIGS. 15-16, the clog 86 has a clog body having a first wall 202 and a second wall 206 spaced from the first wall 202. The walls 202, 206 extend in the X-direction and extend parallel to the rack axis 146. The first wall 202 and the second wall 206 define a cavity 190 for receiving one of the rack extensions 150, 154 of the rack 82. The first wall 202 has a first inner surface 202*a* that is adjacent the cavity 190 and the second wall 206 has a second inner surface 206*a* that is adjacent the cavity 190. In the illustrated embodiment, the walls 202, 206 define a first cavity 190 and a second cavity 194 that are separated by a dividing wall 198. The first cavity 190 is configured to receive the second rack extension 154 from a first rack 82*a* (FIG. 6) and the second cavity 194 in configured to receive the first rack extension 150 from a second rack 82*b* (FIG. 6).

The first wall 202 defines a first pin aperture 210 in the first cavity 190 and in the second cavity 194. The second wall 206 defines a second pin aperture 214 in the first cavity 190 and in the second cavity 194. The first and second pin apertures 210, 214 defined in the first cavity 190 may have a different shape than the first and second pin apertures 210, 214 defined in the second cavity 194. In the illustrated embodiment, the first pin aperture 210*a* and the second pin aperture 214*a* defined in first cavity 190 have slot or oval shape, while the first pin aperture 210*b* and the second pin aperture 214*b* defined in the second cavity 194 have a circular shape.

The first pin aperture 210 is aligned with the second pin aperture 214 such that the pin 90 can extend from the first pin aperture 210 to the second pin aperture 214. When the rack 82 is secured to the clog 86, the pin aperture 162 of the rack 82 is aligned with the pin apertures 210, 214 of the clog 86 such that the pin 90 can extend through all three pin apertures 162, 210, 214.

With reference to FIG. 6, the rack 82*b* spans the joint of a first pan 60*a* and a second pan 60*b*, while the rack 82*a* is installed on the center of the first pan 60*a*. The first end (not shown) of the rack 82*a* is received in a second cavity of a clog (not shown), and the second end 154*b* of the rack 82*a* is received in the second cavity 194 of the clog 86*a*. The rack 82*a* is coupled to the clog 86*a* using the circular pin apertures 210*b*, 214*b*. The first end 150*b* of the rack 82*b* is received in the first cavity 190 of the clog 86*a*, and the second end 154*b* of the rack 82*b* is received in the first cavity 190 of the clog 86*b*. The rack 82*b* is coupled to the clogs 86*a* and 86*b* using the slot shaped pin apertures 210*a*, 214*a*. The slot shaped apertures 210*a*, 214*a* allow the rack 82*b* to 'stretch' and 'contract' as the pans 60 snake into and out of the face conveyor 58.

The first inner surface 202*a* may include at least a first protrusion or first rib 218 (e.g., a first clog rib) that extends at least partially along the first inner surface 202*a*. The first rib 218 creates a raised surface on the first inner surface 202*a*. In the illustrated embodiment, the first rib 218 radially extends from the first pin aperture 210. In the illustrated embodiment, the first pin aperture 210 splits the first rib 218 such that the first rib 218 includes a first rib 218*a* on one side of the first pin aperture 210 and a second rib 218*b* on a different side of the first pin aperture 210. The first set of ribs 218*a*, 218*b* are aligned in one direction. More specifically, the first set of ribs 218*a*, 218*b* extends in the Y-direction parallel to the vertical rack axis 158 and extends perpendicular to the rack axis 146. In another embodiment, the first rib 218 may extend in the Y-direction and be adjacent the first pin aperture 210. In yet another embodiment, the first set of ribs 218*a*, 218*b* may extend in the Y-direction and be positioned on either side of the first pin aperture 210 instead of extending radially from the first pin aperture 210.

The second inner surface 206*a* may include a second protrusion or second rib 222 (e.g., a second of clog rib) that extends at least partially along the second inner surface 206*a*. The second rib 222 creates a raised surface on the second inner surface 206*a*. In the illustrated embodiment, the second rib 222 radially extends from the second pin aperture 214. In the illustrated embodiment, the second pin aperture 214 splits the second rib 222 such that the second rib 222 includes a first rib 222*a* on one side of the second pin aperture 214 and a second rib 222*b* on a different side of the second pin aperture 214. The second set of ribs 222*a*, 222*b* are similar to the first set of ribs 218*a*, 218*b*. The second set of ribs 222*a*, 222*b* extend in the same direction as the first set of ribs 218*a*, 218*b*, and more specifically they extend in the Y-direction parallel to the vertical rack axis 158. In another embodiment, the second rib 222 may extend in the Y-direction and be adjacent the second pin aperture 214. In yet another embodiment, the second set of ribs 222*a*, 222*b* may extend in the Y-direction and be positioned on either side of the second pin aperture 214 instead of extending radially from the second pin aperture 214.

The first and second ribs 218, 222 that extend from the slot shaped pin apertures 210*a*, 214*b* may be wider (e.g., extend further in the X-direction) than the first and second ribs 218, 222 that extend from the circular pin apertures 210*b*, 214*b*. The first and second ribs 218, 222 may be integrally formed with the clog 86, or the first and second ribs 218, 222 may be separate pieces that are installed or fastened onto the inner surfaces 202*a*, 206*a*. The first and second ribs 218, 222 may be formed from the same material as the clog 86 or the first and second ribs 218, 222 may be formed from a different material (e.g., elastic or rubber). The first and second ribs 218, 222 may also have a rough finish (e.g., a speckled surface) to increase the friction coefficient of the first and second ribs 218, 222. In the illustrated embodiment, the first and second ribs 218, 222 have a rectangular shape, but in other embodiments the first and second ribs 218, 222 may have another elongated shape (e.g., oval shape, diamond shape, clongated hexagon). The first and second ribs 218, 222 may define a curved abutment surface, or in other embodiments, the first and second ribs 218, 222 may define a flat abutment surface.

Figure 19:
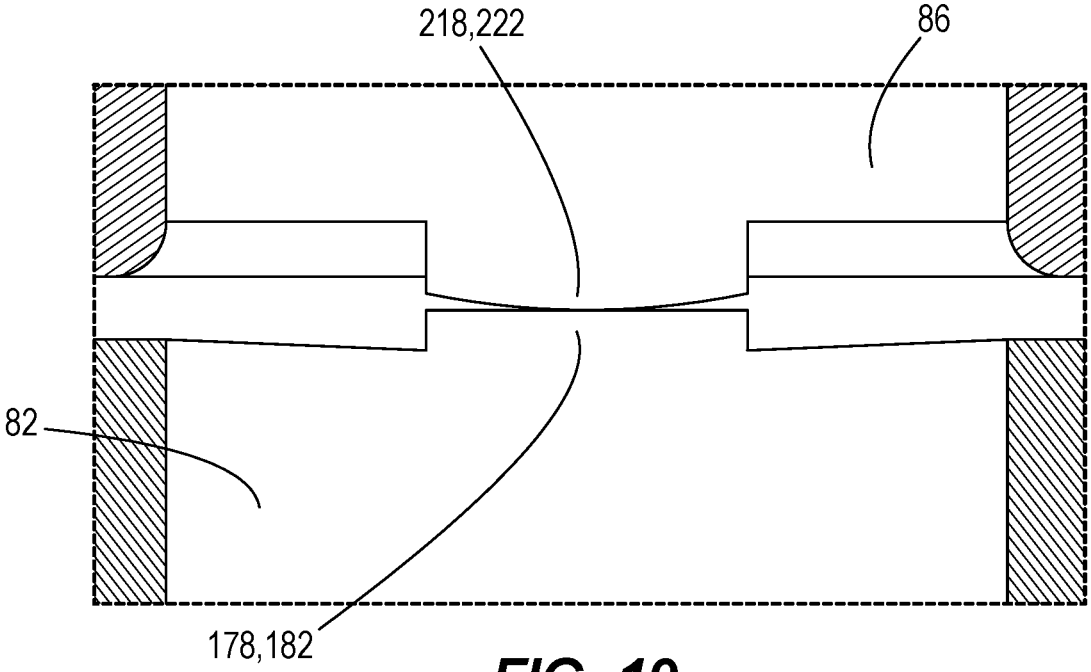
FIG. 19 is an enlarged detail view of a portion of FIG. 18.
Figure 20:
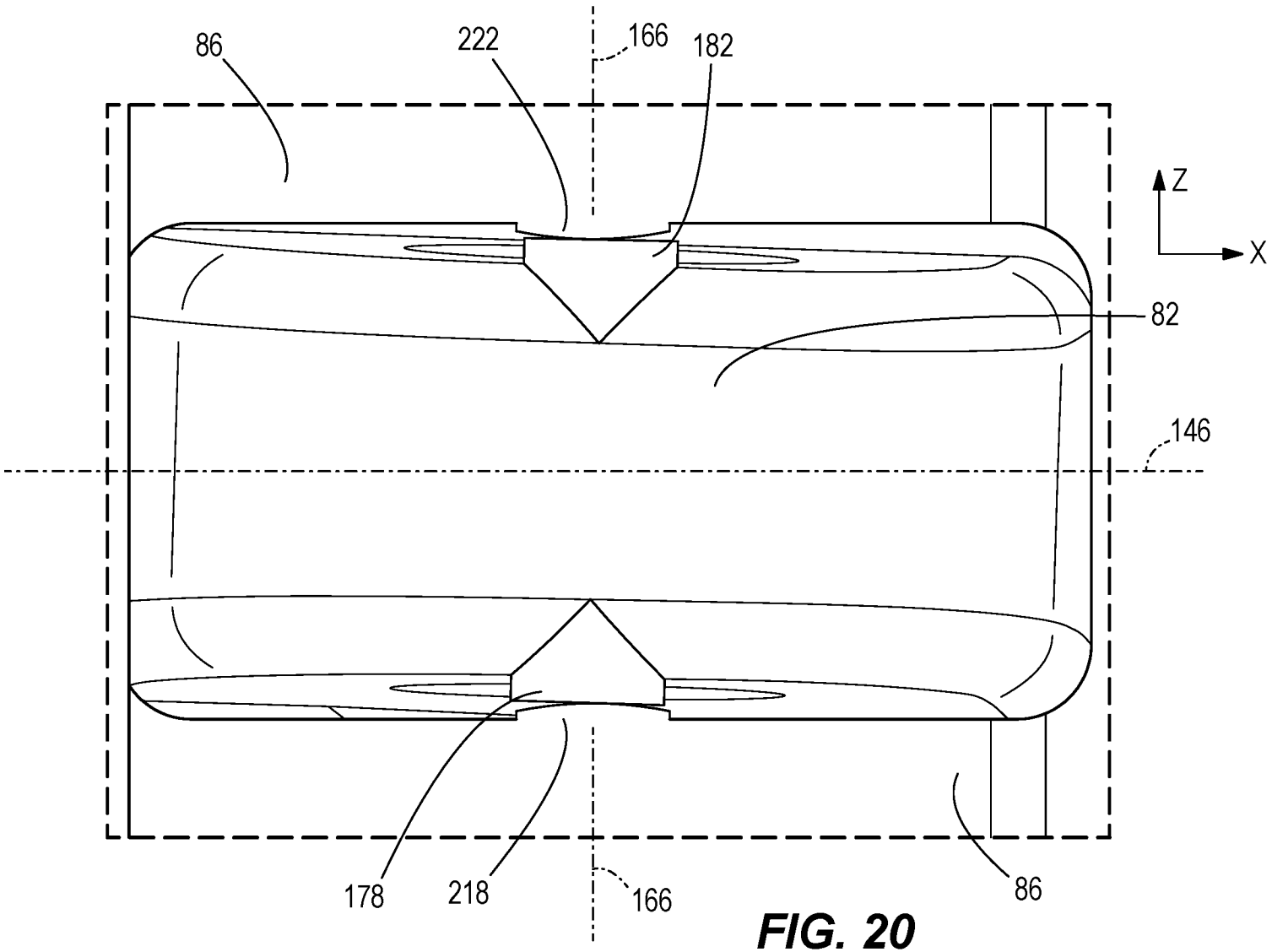
FIG. 20 is a bottom view of the rack of FIG. 12 and the clog of FIG. 15, with the rack rotated about a Y-axis.

The clog ribs 218, 222 may be similar to the rack ribs 178, 182. In other embodiments, the clog ribs 218, 222 may be wider (e.g., extend further in the X-direction) or narrower than the rack ribs 178, 182. In other embodiments, the clog ribs 218, 222 may be thicker (e.g., extend further in the Z-direction) or thinner than the rack ribs 178, 182. As shown in FIG. 19, the clog ribs 218, 222 may define a curved abutment surface while the rack ribs 178, 182 define a flat abutment surface. The curved abutment surface allows the rack to pivot about the vertical rack axis 158, as shown in FIG. 20.

With reference to FIGS. 17-20, when the rack extension 150, 154 is positioned in the cavity 190, 194, the first inner surface 202*a* of the clog 86 is adjacent the inner extension face 170, and the second inner surface 206*a* of the clog 86 is adjacent the outer extension face 174. The inner rack rib 178 may engage (e.g., be in contact with) the first clog rib 218, and the outer rack rib 182 may engage the second clog rib 222 when the rack 82 is supported by the clog 86. The cavity 190, 194 may be larger than the rack extension 150, 154 such that the rack extensions 150, 154 only touch the clog 86 at the clog ribs 218, 222.

Figure 21:
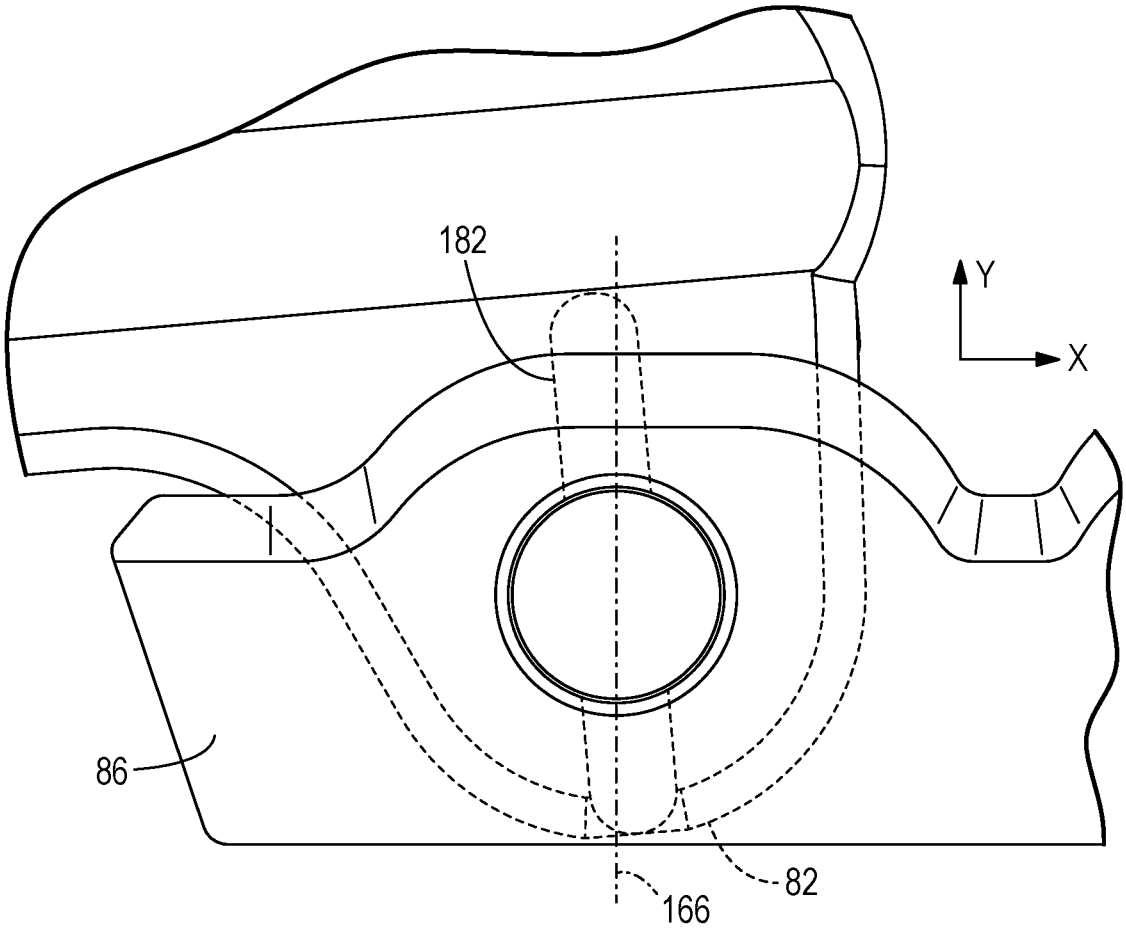
FIG. 21 is a side view of the rack of FIG. 12 and the clog of FIG. 15, with the rack rotated about a Z-axis.

The ribs 178, 182, 218, 222 create a tighter tolerance between the rack 82 and the clog 86. The ribs 178, 182, 218, 222 limit the rotation of the rack 82 about one axis while allowing the rack 82 to freely rotate about the other two axes. More specifically, the ribs 178, 182, 218, 222 limit the rotation of the rack 82 about the rack axis 146 (e.g., the X-axis) and allows the rack 82 to rotate about the about the vertical rack axis 158 (e.g., the Y-axis), as seen in FIG. 20, and about the pin axis of rotation 166 (e.g., the Z-axis), as seen in FIG. 21.

The ribs 178, 182, 218, 222 increase the life of the shearer 10 and increase the control of the shearer 10 because the ribs 178, 182, 218, 222 limit the rotation of the rack 82 in the Y-direction. Rotation of the rack 82 in the Y-direction causes an offset between racks 82*a*, 82*b*; allows more movement of the shearer 10 relative to the face conveyor 58; and create an angled wear surface on the guide shoe 78 and rack 82.

Although the illustrated embodiment shows the both the rack 82 and the clog 86 having sets of ribs that interengage, in some embodiments only the rack 82 or the clog 86 can have a set of ribs. In these embodiments, the ribs may be thicker than the ribs in the illustrated embodiments to engage respective surfaces of either the rack 82 or the clog 86.

Although some aspects of certain embodiments have been described in detail, variations and modifications exist within the scope and spirit of one or more independent aspects as described.

What is claimed is:

1. A rackbar for a mining machine, the rackbar comprising:

a body including a first end and a second end;

an inner rack wall extending between the first end and the second end along a rack axis;

an outer rack wall spaced from the inner rack wall and extending between the first end and the second end parallel to the rack axis;

a plurality of gear teeth, each of the gear teeth extending between the inner rack wall and the outer rack wall;

an extension disposed adjacent the first end, the extension extending in a direction perpendicular to the rack axis;

a pin aperture positioned on the extension and configured to receive a pin; and a rib protruding from a surface of the extension.

2. The rackbar of claim 1, wherein the rib extends in a direction perpendicular to the rack axis.

3. The rackbar of claim 1, wherein the rib is one of a plurality of ribs, the plurality of ribs oriented in the same direction.

4. The rackbar of claim 3, wherein the plurality of ribs extend in a direction perpendicular to the rack axis.

5. The rackbar of claim 4, wherein the plurality of ribs radially extend from the pin aperture.

6. The rackbar of claim 1, wherein the extension has an inner face and an outer face opposite the inner face, and the rib is disposed on the inner face.

7. The rackbar of claim 6, wherein the rib is an inner rib, and further comprising an outer rib disposed on the outer face.

8. The rackbar of claim 1, wherein the rackbar is a unitary body.

9. A clog for supporting a rackbar of a mining machine, the clog comprising:

a first wall extending in a first direction;

a second wall spaced from the first wall, the second wall extending parallel to the first direction;

a cavity between the first wall and the second wall, the cavity configured to receive a portion of the rackbar;

a first pin aperture positioned on the first wall;

a second pin aperture positioned on the second wall; and a rib positioned on one of the first wall and the second wall, the rib positioned on and protruding from a surface adjacent the cavity, the rib being elongated in a second direction that is perpendicular to the first direction.

10. The clog of claim 9, wherein the rib is one of a plurality of ribs, the plurality of ribs extending in the same direction.

11. The clog of claim 10, wherein the plurality of ribs extend in a second direction that is perpendicular to the first direction.

12. The clog of claim 9, wherein the rib is a first rib and is positioned on the first wall, further comprising a second rib positioned on a surface of the second wall adjacent the cavity.

13. The clog of claim 12, wherein the first rib and the second rib extend in a second direction perpendicular to the first direction.

14. The clog of claim 12, wherein the first rib extends from the first pin aperture.

15. The clog of claim 9, wherein the rib includes a curved abutment surface.

16. A mining machine comprising:

a rackbar including, a body including a first end and a second end, an inner rack wall extending between the first end and the second end along a rack axis, an outer rack wall spaced from the inner rack wall and extending between the first end to the second end parallel to the rack axis, a plurality of gear teeth, each of the gear teeth extending between the inner rack wall and the outer rack wall, an extension disposed adjacent the first end, the extension extending in a direction perpendicular to the rack axis, a pin aperture positioned on the extension, and an inner rack rib protruding from a surface of the extension; and a clog supporting the rackbar, the clog including, a first wall extending parallel to the rack axis, a second wall spaced from the first wall, the second wall extending parallel the rack axis, a cavity between the first wall and the second wall, the cavity configured to receive the extension of the rackbar, a first pin aperture disposed on the first wall, a second pin aperture disposed on the second wall, a clog rib positioned on one of the first wall and the second wall, the clog rib positioned on and protruding from a surface adjacent the cavity, and a pin securing the rackbar to the clog.

17. The mining machine of claim 16, wherein the inner rack rib and the clog rib extend along a first direction.

18. The mining machine of claim 17, wherein the first direction is perpendicular to the rack axis.

19. The mining machine of claim 18, wherein the inner rack rib is one of a plurality of inner rack ribs, and the first clog rib is one of a first plurality of clog ribs.

20. The mining machine of claim 16, wherein the extension has an inner face and an outer face opposite the inner face, wherein the inner rack rib is disposed on the inner face, and the outer face includes an outer rack rib.

21. The mining machine of claim 20, wherein the clog rib is a first clog rib, and the second wall includes a second clog rib extending along the second wall adjacent the cavity.

22. The mining machine of claim 21, wherein the inner rack rib, the outer rack rib, the first clog rib, and the second clog rib extend perpendicular to the rack axis.

23. The mining machine of claim 21, wherein the inner rack rib is engaged with the first clog rib and the outer rack rib is engaged with the second clog rib when the rackbar is supported by the clog.

24. The mining machine of claim 16, wherein the inner rack rib includes a flat abutment surface, and the clog rib includes a curved abutment surface.

25. The mining machine of claim 24, wherein the inner rack rib engages the clog rib when the rackbar is supported by the clog.

* * * * *